US005393309A

United States Patent [19]

Cherpeck

[11] Patent Number: 5,393,309

[45] Date of Patent: Feb. 28, 1995

[54] FUEL ADDITIVE COMPOSITIONS CONTAINING POLYISOBUTENYL SUCCINIMIDES

[75] Inventor: Richard E. Cherpeck, Cotati, Calif.

[73] Assignee: Chevron Research and Technology Company, San Francisco, Calif.

[21] Appl. No.: 246,378

[22] Filed: May 19, 1994

Related U.S. Application Data

[63] Continuation of Ser. No. 759,320, Sep. 13, 1991, abandoned.

[51] Int. Cl.[6] ..... C10L 1/22; C10L 1/18

[52] U.S. Cl. ..... 44/347

[58] Field of Search ..... 44/347

[56] References Cited

U.S. PATENT DOCUMENTS

| | | | |
|---|---|---|---|
| 3,223,495 | 12/1965 | Calvino et al. | 44/347 |
| 3,310,492 | 3/1967 | Benoit, Jr. | 44/347 |
| 3,443,918 | 5/1969 | Kautsky et al. | 44/347 |
| 3,676,089 | 7/1972 | Morris | 44/347 |
| 3,717,446 | 2/1973 | Howland et al. | 44/347 |
| 3,795,495 | 3/1974 | Howland et al. | 44/347 |
| 4,039,300 | 8/1977 | Chloupek | 44/347 |
| 4,240,803 | 12/1980 | Andress, Jr. | 44/63 |
| 4,325,708 | 4/1982 | Bagnetto, Jr. | 44/347 |
| 4,531,948 | 7/1985 | Knapp | 44/347 |
| 4,863,487 | 9/1987 | Meyer et al. | 44/347 |
| 5,089,028 | 2/1992 | Abramo et al. | 44/347 |
| 5,114,435 | 5/1992 | Abramo et al. | 44/348 |

FOREIGN PATENT DOCUMENTS

| | | |
|---|---|---|
| 0376578 | 7/1990 | European Pat. Off. . |
| 0460957 | 12/1991 | European Pat. Off. . |
| 0476196 | 3/1992 | European Pat. Off. . |
| 0526129 | 2/1993 | European Pat. Off. . |
| 1486144 | 9/1977 | United Kingdom . |
| 9113949 | 9/1991 | WIPO . |

*Primary Examiner*—Jacqueline V. Howard
*Attorney, Agent, or Firm*—C. J. Caroli

[57] ABSTRACT

A fuel additive composition comprising (a) a polyisobutenyl succinimide derived from ethylenediamine or diethylenetriamine, wherein the polyisobutenyl group has an average molecular weight of about 1200 to 1500 and (b) a nonvolatile paraffinic or naphthenic carrier oil, or a mixture thereof.

18 Claims, No Drawings

FUEL ADDITIVE COMPOSITIONS CONTAINING POLYISOBUTENYL SUCCINIMIDES

This is a continuation of application Ser. No. 07/759,320, filed Sep. 13, 1991, now abandoned.

BACKGROUND OF THE INVENTION

1. Field of the Invention

This invention relates to a fuel additive composition. More particularly, this invention relates to a fuel additive composition containing a polyisobutenyl succinimide detergent additive and a carrier oil.

2. Description of the Relevant Art

It is well known in the art that liquid hydrocarbon combustion fuels, such as fuel oils and gasolines, tend to exhibit certain deleterious characteristics, either after long periods of storage or under actual operational conditions. Gasolines, for example, in operational use tend to deposit sludge and varnish at various points in the power system, including the carburetor or injectors and the intake valves. It is desirable, therefore, to find a means for improving liquid hydrocarbon fuels by lessening their tendency to leave such deposits.

U.S. Pat. No. 4,240,803 discloses a liquid hydrocarbon fuel composition comprising fuel and a detergent amount of an alkenyl succinimide prepared by reacting an alkenyl succinic acid or anhydride, wherein the alkenyl substituent is derived from a specific mixture of $C_{16}$–$C_{28}$ a olefins, with a polyalkylene polyamine. This patent teaches that for unexpected effectiveness as a liquid hydrocarbon detergent, it is essential that the alkenyl group attached to the succinimide be derived from a mixture of $C_{16}$–$C_{28}$ olefins obtained as the bottoms product from an olefin oligomerization.

European Patent Application No. 376,578 discloses a three-component additive composition for reducing carbon deposits in internal combustion engines comprising (a) a polyalkylene succinimide, (b) a polyalkylene, and (c) a mineral oil. Also disclosed is a liquid fuel composition containing such additive composition, as well as a method for cleaning a gasoline internal combustion engine utilizing this composition. The sole example disclosed in this European application shows the use of a polyisobutylene succinimide additive in intake valve and carburetor cleanliness tests. However, no mention is made in the example of the type of polyamine used to prepare the succinimide or the molecular weight of the polyisobutylene substituent.

British Patent No. 1,486,144 discloses a gasoline additive composition comprising (a) a hydrocarbyl-substituted succinimide, (b) a polymer of a $C_2$ to $C_6$ unsaturated hydrocarbon, and (c) a paraffinic or naphthenic oil. Example 1 of the British patent discloses a polyisobutylene succinimide, wherein the polyisobutylene group has a molecular weight of about 900 and the imide moiety is derived from diethylene triamine, in combination with a paraffinic oil and about 28 weight percent of polypropylene having a molecular weight of about 800. This British patent further teaches that all three components are essential to achieving a reduction in carbonaceous deposits. U.S. Pat. No. 4,039,300 discloses a composition for fueling an internal combustion engine equipped with at least one carburetor, which comprises a major amount of hydrocarbons boiling in the gasoline range, a minor amount of at least one detergent and a minor amount of mineral oil of lubricating viscosity comprising at least 50 percent by weight of aromatic hydrocarbons having an average molecular weight of 300 to 700, the detergent and oil being present in amounts sufficient to inhibit formation of deposits on the carburetor. Among the detergents disclosed are polyaminopolyalkylene alkenyl succinimides, preferably polyisobutenyl succinimides. Thus, the thrust of this patent is the use of an aromatic-rich mineral oil containing at least 50 percent aromatic hydrocarbons, in combination with known detergent additives.

SUMMARY OF THE INVENTION

The present invention provides a novel fuel additive composition comprising:

(a) a polyisobutenyl succinimide of the formula

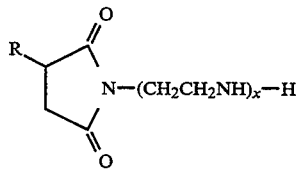

wherein R is a polyisobutenyl group having a number average molecular weight in the range of about 1200 to 1500, and x is 1 or 2; and (b) a nonvolatile paraffinic or naphthenic carrier oil, or a mixture thereof.

The present invention further provides a fuel composition comprising a major amount of hydrocarbons boiling in the gasoline or diesel range and an effective detergent amount of the novel fuel additive composition described above.

The present invention is also concerned with a fuel concentrate comprising an inert stable oleophilic organic solvent boiling in the range of from about 150° F. to 400° F. and from about 10 to 50 weight percent of the fuel additive composition of the instant invention.

Among other factors, the present invention is based on the surprising discovery that the unique combination of a polyisobutenyl succinimide and a carrier oil, wherein the polyisobutenyl succinimide is derived from ethylenediamine or diethylenetriamine and the polyisobutenyl group has an average molecular weight of about 1200 to 1500, provides unexpectedly superior deposit control performance when compared to prior art polyisobutenyl succinimides of lower molecular weight.

DETAILED DESCRIPTION OF THE INVENTION

As noted above, the succinimide component of the present fuel additive composition is a polyisobutenyl succinimide derived from ethylenediamine or diethylenetriamine, wherein the polyisobutenyl group has an average molecular weight in the range of about 1200 to 1500, preferably about 1200 to 1400, and more preferably about 1250 to 1350. An especially preferred polyisobutenyl group has an average molecular weight of about 1300.

The succinimides employed in the present invention are prepared by reacting ethylenediamine or diethylenetriamine with a polyisobutenyl succinic anhydride as shown in the following reaction:

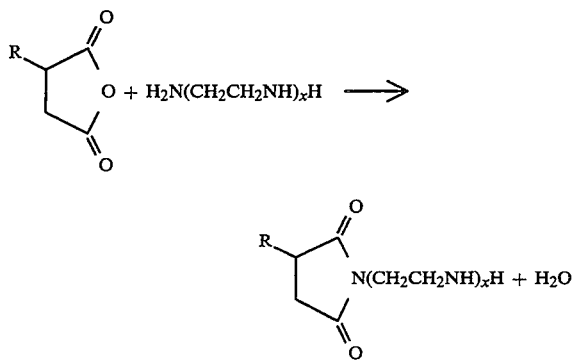

where x is 1 or 2 and R is a polyisobutenyl group having an average molecular weight of about 1200 to about 1500, preferably about 1200 to about 1400, more preferably about 1250 to 1350, and most preferably about 1300.

Polyisobutenyl succinic anhydrides are well known in the art and are prepared by the thermal reaction of polyisobutene and maleic anhydride as described, for example, in U.S. Pat. Nos. 3,361,673 and 3,676,089. Alternatively, polyisobutenyl succinic anhydrides can be prepared by reaction of chlorinated polyisobutene with maleic anhydride as described, for example, in U.S. Pat. No. 3,172,892. The polyisobutene employed in these reactions is commercially available and has an average number of carbon atoms per polyisobutene molecule ranging from about 85 to about 110. The polyisobutene has a number average molecular weight in the range of about 1200 to about 1500. Preferably, the number average molecular weight of the polyisobutene is about 1200 to about 1400, more preferably about 1250 to 1350, and most preferably about 1300.

The reaction of a polyamine with an alkenyl or alkyl succinic anhydride to produce a polyamino alkenyl or alkyl succinimide is well known is the art and is described, for example, in U.S. Pat. Nos. 3,018,291; 3,024,237; 3,172,892; 3,219,666; 3,223,495; 3,272,746; 3,361,673 and 3,443,918.

Polyamines containing two primary amines, such as ethylenediamine and diethylenetriamine, can react with a succinic anhydride to produce either a mono- or bis-succinimide or both. The monosuccinimides used in this invention are prepared as the predominant reaction products by controlling the molar ratio of the reactants. The molar ratio of ethylenediamine or diethylenetriamine to polyisobutenyl succinic anhydride employed in this invention is generally in the range of from about 0.85:1 to 10:1. The molar ratio of ethylenediamine to polyisobutenyl succinic anhydride is preferably in the range of 2:1 to 10:1 and is most preferably 5:1. When an excess of ethylenediamine is used, the excess ethylenediamine is conveniently separated from the monosuccinimide by distillation. When diethylenetriamine is used, the molar ratio of diethylenetriamine to polyisobutenyl succinic anhydride is preferably in the range of about 0.85:1 to 0.95:1, and more preferably about 0.87:1 to 0.93:1. An excess of diethylene triamine is generally not employed, as the diethylene triamine is more difficult to separate from the desired monosuccinimide product.

The reaction of ethylenediamine or diethylenetriamine with polyisobutenyl succinic anhydride may be conducted in the absence of solvent, or alternatively, in the presence of an inert solvent, such as toluene, xylene, $C_9$ aromatic hydrocarbons, chloroform, 100 neutral oils and the like. The reaction is typically conducted at a temperature in the range of about 80° C. to about 200° C. Reaction temperatures in the range of about 150° C. to about 170° C. are generally preferred.

The carrier oil employed in the fuel additive composition of the present invention is a non-volatile paraffinic or naphthenic oil, or a mixture thereof. The expression "non-volatile" is meant to indicate an oil which is not volatile at normal engine intake valve temperatures, generally about 175° C. to 300° C.

Preferably, the carrier oil will be a mixture of paraffinic and naphthenic oils. One preferred mixture contains about 70 percent paraffinic oil and about 30 percent naphthenic oil. Typically, the carrier oil will have a viscosity of about 300 to 3000 SUS at 100° F., and preferably about 400 to 1000 SUS. Examples of suitable carrier oils include Chevron Neutral Oil 500R and Chevron Neutral Oil 600P, available from Chevron U.S.A. Inc., San Francisco, Calif. and BP Neutral Oil 500SNO, available from BP Chemical Company, Cleveland, Ohio. The carrier oil may also contain a minor amount, up to about 10%, of aromatic material.

The carrier oil employed in the present invention is believed to act as a carrier for the polyisobutenyl succinimide detergent additive and assist in removing and retarding deposits. The carrier oil is employed in fuels in amounts ranging from about 0.005 to 0.5 percent by volume, based on the final fuel composition. Preferably, about 100 to 5000 ppm by weight of the carrier oil will be used in the final fuel composition. Generally, the weight ratio of carrier oil to polyisobutenyl succinimide will be at least about 2:1, and preferably will be at least about 4:1.

Fuel Compositions

The fuel additive composition of the present invention will generally be employed in a hydrocarbon distillate fuel boiling in the gasoline or diesel range. The proper concentration of this additive composition necessary in order to achieve the desired detergency and dispersancy varies depending upon the type of fuel employed, the presence of other detergents, dispersants and other additives, etc. Generally, however, from 150 to 7500 weight ppm, preferably from 300 to 2500 ppm, of the present additive composition per part of base fuel is needed to achieve the best results.

In terms of individual components, fuel compositions containing the additive compositions of the invention will generally contain about 50 to 2500 ppm of the polyisobutenyl succinimide and about 100 to 5000 ppm of the carrier oil, with the ratio of carrier oil to succinimide being at least about 2:1.

The deposit control additive may be formulated as a concentrate, using an inert stable oleophilic organic solvent boiling in the range of about 150° to 400° F. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the detergent-dispersant additive. In the concentrate, the amount of the present additive composition will be ordinarily at least 10% by weight and generally not exceed 70% by weight, preferably 10–50 wt. % and most preferably from 10 to 25 wt. %.

In gasoline fuels, other fuel additives may also be included such as antiknock agents, e.g., methylcyclopentadienyl manganese tricarbonyl, tetramethyl or tetraethyl lead, or other dispersants or detergents such as various substituted amines, etc. Also included may be lead scavengers such as aryl halides, e.g., dichlorobenzene or alkyl halides, e.g., ethylene dibromide. Additionally, antioxidants, metal deactivators, pour point depressants, corrosion inhibitors and demulsifiers may be present.

In diesel fuels, other well-known additives can be employed, such as pour point depressants, flow improvers, cetane improvers, and the like.

The following examples are presented to illustrate specific embodiments of this invention and are not to be construed in any way as limiting the scope of the invention.

EXAMPLES

Example 1—(Comparative)

To a flask equipped with a magnetic stirrer, Dean Stark trap, reflux condenser, thermometer and nitrogen inlet was added 350 grams of polyisobutenylsuccinic anhydride (0.24 moles, saponification number=78.0) where the polyisobutenyl group has a number average molecular weight of 950. A solvent consisting of primarily $C_9$ aromatic hydrocarbons (350 grams) was added and the mixture was heated to 100° C. until the anhydride had completely dissolved. The reaction mixture was then cooled to room temperature and 5.0 equivalents of ethylenediamine (73.18 grams) were added all at once. The reaction was heated at 160° C. for eight hours after which time all of the water and excess ethylenediamine had been collected. The reaction mixture was dried over anhydrous sodium sulfate and filtered to yield 629.5 grams of product. The product which contained 36.0% by weight actives had an acidity value (AV)=29.5 and contained 1.39% by weight nitrogen.

Example 2—(Comparative)

To a flask equipped with a magnetic stirrer, Dean Stark trap, reflux condenser, thermometer and nitrogen inlet was added 275 grams of polyisobutenylsuccinic anhydride (0.18 moles, saponification number=74.2) where the polyisobutenyl group has a number average molecular weight of 950. A solvent consisting of primarily $C_9$ aromatic hydrocarbons (275 grams) was added and the mixture was heated to 110° C. until the anhydride had completely dissolved. The reaction mixture was then cooled to room temperature and 5.0 equivalents of diethylenetriamine (93.78 grams) were added all at once. The reaction was heated at 160° C. for eight hours and then cooled to room temperature. The reaction was diluted with 2000 milliliters of pentane and washed with saturated aqueous sodium chloride (2×500 milliliters). The pentane layer was dried over anhydrous sodium sulfate, filtered and the pentane removed on the rotary evaporator to yield 506.3 grams of product. The product which contained 36.4% by weight actives had an AV=50.0 and contained 2.22% by weight nitrogen.

Example 3

To a flask equipped with a magnetic stirrer, Dean Stark trap, reflux condenser, thermometer and nitrogen inlet was added 350 grams of polyisobutenylsuccinic anhydride (0.20 moles, saponification number=63.3) where the polyisobutenyl group has a number average molecular weight of 1300. A solvent consisting of primarily $C_9$ aromatic hydrocarbons (350 grams) was added and the mixture was heated to 100° C. until the anhydride had completely dissolved. The reaction mixture was then cooled to room temperature and 5.0 equivalents of ethylenediamine (59.32 grams) were added all at once. The reaction was heated at 160° C. for eight hours after which time all of the water and excess ethylenediamine had been collected. The reaction mixture was dried over anhydrous sodium sulfate and filtered to yield 651.8 grams of product. The product which contained 35.6% by weight actives had an AV=29.3 and contained 1.26% by weight nitrogen.

Example 4

To a flask equipped with a magnetic stirrer, Dean Stark trap, reflux condenser, thermometer and nitrogen inlet was added 350 grams of polyisobutenylsuccinic anhydride (0.20 moles, saponification number=63.3) where the polyisobutenyl group has a number average molecular weight of 1300. A solvent consisting of primarily $C_9$ aromatic hydrocarbons (350 grams) was added and the mixture was heated to 100° C. until the anhydride had completely dissolved. The reaction mixture was then cooled to room temperature and 5.0 equivalents of diethylenetriamine (101.83 grams) were added all at once. The reaction was heated at 160° C. for eight hours and then cooled to room temperature. The reaction was diluted with 2000 milliliters of pentane and washed with saturated aqueous sodium chloride (2×500 milliliters). The pentane layer was dried over anhydrous sodium sulfate, filtered and the pentane removed on the rotary evaporator to yield 635.5 grams of product. The product which contained 36.3% by weight actives had an AV=36.8 ad contained 1.73% by weight nitrogen.

Example 5

To a flask equipped with a mechanical stirrer, Dean Stark trap, reflux condenser, thermometer and nitrogen inlet was added 2055 grams of polyisobutenylsuccinic anhydride (1.07 moles, saponification number=58.3) where the polyisobutenyl group has a number average molecular weight of 1300. The polyisobutenylsuccinic anhydride was heated to 85° C. and five equivalents of ethylenediamine (320.93 grams) were added over twenty minutes. The resulting mixture foamed up and the foam was contained by the size of the vessel. The reaction was heated at 150° C. for six hours after which time all of the excess ethylenediamine and water had been collected. The reaction was cooled to 100° C. and diluted with a solvent consisting of primarily $C_9$ aromatic hydrocarbons (1034.4 grams) to 50% actives. The product had an AV=25.5 and contained 1.29% by weight nitrogen.

Example 6

To a flask equipped with a mechanical stirrer, Dean Stark trap, reflux condenser, thermometer and nitrogen inlet was added 3670 grams of polyisobutenylsuccinic anhydride (2.01 moles, saponification number=61.4) where the polyisobutenyl group has a number average molecular weight of 1300. The polyisobutenylsuccinic anhydride was heated to 110° C. and 0.87 equivalents of diethylenetriamine (180.55 grams) were added all at once. The reaction was heated at 160° C. for six hours after which time all of the water had been collected. The reaction was cooled to 80° C. and diluted with a solvent consisting of primarily $C_9$ aromatic hydrocarbons (1773.9 grams) to 50% actives. The product had an AV=23.1 and contained 1.34% by weight nitrogen.

Example 7—Deposit Control Evaluation

In the following tests, the fuel additive compositions of the invention were blended in gasoline and their deposit control capacity tested in an ASTM/CFR Single-Cylinder Engine Test.

In carrying out the tests, a Waukesha CFR single-cylinder engine is used. The run is carried out for 15 hours, at the end of which time the intake valve is removed, washed with hexane and weighed. The previously determined weight of the clean valve is subtracted from the weight of the valve. The difference between the two weights is the weight of the deposit with a lesser amount of deposit measured connoting a superior additive. The operating conditions of the test are as follows: water jacket temperature 100° C. (212° F.); manifold vacuum of 12 in. Hg; intake mixture temperature 50.2° C. (125° F.); air-fuel ratio of 12; ignition spark timing of 40° BTC; engine speed is 1800 rpm; the crankcase oil is a commercial 30W oil. The amount of carbonaceous deposit in milligrams on the intake valves is measured and reported in the following Table I.

The base fuel tested in the above test is a regular octane unleaded gasoline containing no fuel deposit control additive. The base fuel is admixed with the various detergent additives at 100 ppma (parts per million of actives), along with 400 ppm Chevron 500R carrier oil. Also presented in Table I for comparison purposes are values for a commercially available nitrogen-containing deposit control additive having recognized performance in the field.

The data in Table I show that the fuel additive compositions of the present invention are markedly superior in deposit control performance to both the lower molecular weight succinimide compositions and the commercial additive.

TABLE I

| SAMPLE[1] | INTAKE VALVE DEPOSIT WEIGHT (in milligrams) | | | |
|---|---|---|---|---|
| | Run 1 | Run 2 | Run 3 | Average |
| Example 1 (Comparative) | 151.5 | 142.5 | 89.7 | 127.9 |
| Example 2 (Comparative) | 100.2 | 148.0 | 67.3 | 105.2 |
| Example 3 | 63.5 | 94.8 | 58.3 | 72.2 |
| Example 4 | 37.0 | 35.6 | 32.8 | 35.1 |
| Commercial Additive | 104.5 | 97.3 | 132.8 | 111.5 |
| BASE FUEL | 182.7 | 164.9 | | 173.8 |

[1]100 ppm detergent additive and 400 ppm Chevron 500R carrier oil.

What is claimed is:

1. A fuel additive consisting essentially of comprising:

(a) a polyisobutenyl succinimide of the formula

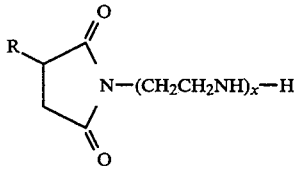

wherein R is a polyisobutenyl group having a number average molecular weight in the range of about 1200 to 1500, and x is 1 or 2; and (b) a nonvolatile paraffinic or naphthenic carrier oil, or a mixture thereof, containing no more than about 10% of aromatic material.

2. The composition according to claim 1, wherein R has a number average molecular weight in the range of about 1200 to 1400.

3. The composition according to claim 2, wherein R has a number average molecular weight in the range of about 1250 to 1350.

4. The composition according to claim 3, wherein R has a number average molecular weight of about 1300.

5. The composition according to claim 1, wherein x is 1.

6. The composition according to claim 1, wherein x is 2.

7. A fuel composition consisting essentially of a major amount of hydrocarbons boiling in the gasoline or diesel range and an effective detergent amount of an additive composition comprising:

(a) a polyisobutenyl succinimide having the formula

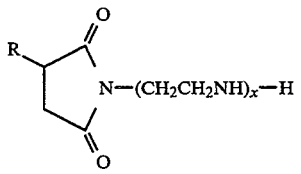

wherein R is a polyisobutenyl group having a number average molecular weight in the range of about 1200 to 1500, and x is 1 or 2; and (b) a nonvolatile paraffinic or naphthenic carrier oil, or a mixture thereof, containing no more than about 10% of aromatic material.

8. The composition according to claim 7, wherein R has a number average molecular weight in the range of about 1200 to 1400.

9. The composition according to claim 8, wherein R has a number average molecular weight in the range of about 1250 to 1350.

10. The composition according to claim 9, wherein R has a number average molecular weight of about 1300.

11. The composition according to claim 7, wherein x is 1.

12. The composition according to claim 7, wherein x is 2.

13. A fuel concentrate consisting essentially of an inert stable oleophilic organic solvent boiling in the range of from about 150° F. to 400° F. and from about 10 to 50 weight percent of an additive composition comprising:

(a) a polyisobutenyl succinimide having the formula

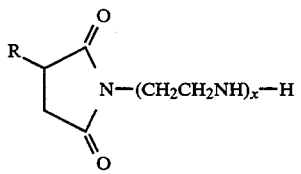

wherein R is a polyisobutenyl group having a number average molecular weight in the range of about 1200 to 1500, and x is 1 or 2; and (b) a nonvolatile paraffinic or naphthenic carrier oil, or a mixture thereof, containing no more than about 10% of aromatic material.

14. The fuel concentrate according to claim 13, wherein R has a number average molecular weight in the range of about 1200 to 1400.

15. The fuel concentrate according to claim 14, wherein R has a number average molecular weight in the range of about 1250 to 1350.

16. The fuel concentrate according to claim 15, wherein R has a number average molecular weight of about 1300.

17. The fuel concentrate according to claim 13, wherein x is 1.

18. The fuel concentrate according to claim 13, wherein x is 2.

* * * * *